US006405941B2

(12) United States Patent
Ganser

(10) Patent No.: US 6,405,941 B2
(45) Date of Patent: Jun. 18, 2002

(54) FUEL INJECTION VALVE FOR INTERNAL COMBUSTION ENGINES

(75) Inventor: Marco A. Ganser, Zurich (CH)

(73) Assignee: Ganser-Hydromag AG, Oberageri (CH)

( * ) Notice: Subject to any disclaimer, the term of this patent is extended or adjusted under 35 U.S.C. 154(b) by 0 days.

(21) Appl. No.: 09/852,344

(22) Filed: May 10, 2001

Related U.S. Application Data

(63) Continuation of application No. PCT/CH99/00499, filed on Oct. 21, 1999.

(30) Foreign Application Priority Data

Nov. 10, 1998 (CH) ..... 2251/98

(51) Int. Cl.[7] ..... F02M 47/02; F02M 41/16; F02M 51/00; B05B 1/30

(52) U.S. Cl. ..... 239/88; 239/96; 239/533.2; 239/533.3; 239/533.11; 239/124; 239/585.1

(58) Field of Search ..... 239/88, 96, 124, 239/533.2, 533.3, 533.4, 533.5, 533.11, 585.1

(56) References Cited

U.S. PATENT DOCUMENTS 5,685,483 A * 11/1997 Ganser ..... 239/533.3
5,694,903 A * 12/1997 Ganser ..... 239/96
5,842,640 A * 12/1998 Ganser ..... 239/533.3
5,860,597 A * 1/1999 Tarr ..... 239/88
5,873,526 A * 2/1999 Cooke ..... 239/88
6,012,430 A * 1/2000 Cooke ..... 239/96

FOREIGN PATENT DOCUMENTS

DE 19650865 A1 * 5/1998
GB 2246175 A * 1/1992

* cited by examiner

*Primary Examiner*—Lesley D. Morris
*Assistant Examiner*—Robin O. Evans
(74) *Attorney, Agent, or Firm*—McDermott, Will & Emery

(57) ABSTRACT

A fuel injection valve for intermittent injection of fuel into the combustion chamber of a diesel or other form of internal combustion engine. The valve achieves a shorter than usual injection valve member, while avoiding valve member oscillation but retaining precise closing by implementing a solenoid controlled piston that controls movement of the valve. The piston in turn is acted upon by fuel system pressure from a high pressure feed line and from a control chamber, alternatively, depending upon the position of an actuating element. The control piston has an annular land that faces the control chamber and the piston is connected to the high pressure feed line through a tight sliding fit in a piston guide bore establishing a leak gap. A relief chamber is formed between the outlet side of the gap and the land. When the injection valve is open, the land reduces fuel flow from the relief chamber into the control chamber. As a result, fuel pressure in the relief chamber rises compared to that in the control chamber.

14 Claims, 6 Drawing Sheets

FUEL INJECTION VALVE FOR INTERNAL COMBUSTION ENGINES

This application is a continuation of International Application No. PCT/CH99/00499, whose international filing date is Oct. 21, 1999, which in turn claims the benefit of Switzerland Application No. 1998 2251/98, filed Nov. 10, 1998, the disclosures of which Applications are incorporated by reference herein. The benefit of the filing and priority dates of the International and Switzerland Applications is respectfully requested.

The invention relates to a fuel injection valve for intermittent fuel injection into the combustion chamber of an internal combustion engine according to the preamble of claim 1. The said injection valve may be used, for example in so-called common rail injection systems for diesel engines.

Fuel injection valves of this type are disclosed by the patent specifications EP 0 262 539, EP 0 603 616 or U.S. Pat. No. 5,685,483. In these known fuel injection valves the opening and closing movement of the injection valve member is controlled by controlling the control chamber pressure in a control chamber above a control piston, which is operatively connected to the injection valve member. At the end of its opening movement the injection valve member is stopped by a mechanical stop.

In EP 0 603 616 the injection valve member is long and made up of multiple parts. The length of the injection valve member is dependent upon the engine design according to the injection system application in a certain type of engine. In this known solution the stop is situated at a distance from the upper end of the injection valve member. This causes an oscillation of the free, upper end of the injection valve member after its opening movement has ceased. This oscillation causes undesirable, imprecise closing movements of the injection valve member at the end of the injection sequence.

The injection valve member is also long in EP 0 262 539. The opening movement of the injection valve member is stopped by a stop surface between the upper end of the control piston and an underside of a piston guide part inside the control chamber. Although this arrangement avoids the above-mentioned oscillation, the detachment of the injection valve member from the stop surface at the beginning of the closing movement is associated with uncontrollable, transient fluctuations, which once again cause imprecise closing.

The object of the present invention is both to prevent the oscillation and to ensure detachment of the injection valve member in a precisely controllable manner, so that the injection sequences can be performed with great reproducibility and accuracy.

According to the invention this object is achieved by the features specified in the defining part of claim 1.

The invention will now be explained in more detail below with reference to the drawings, in which.

Figure 1:
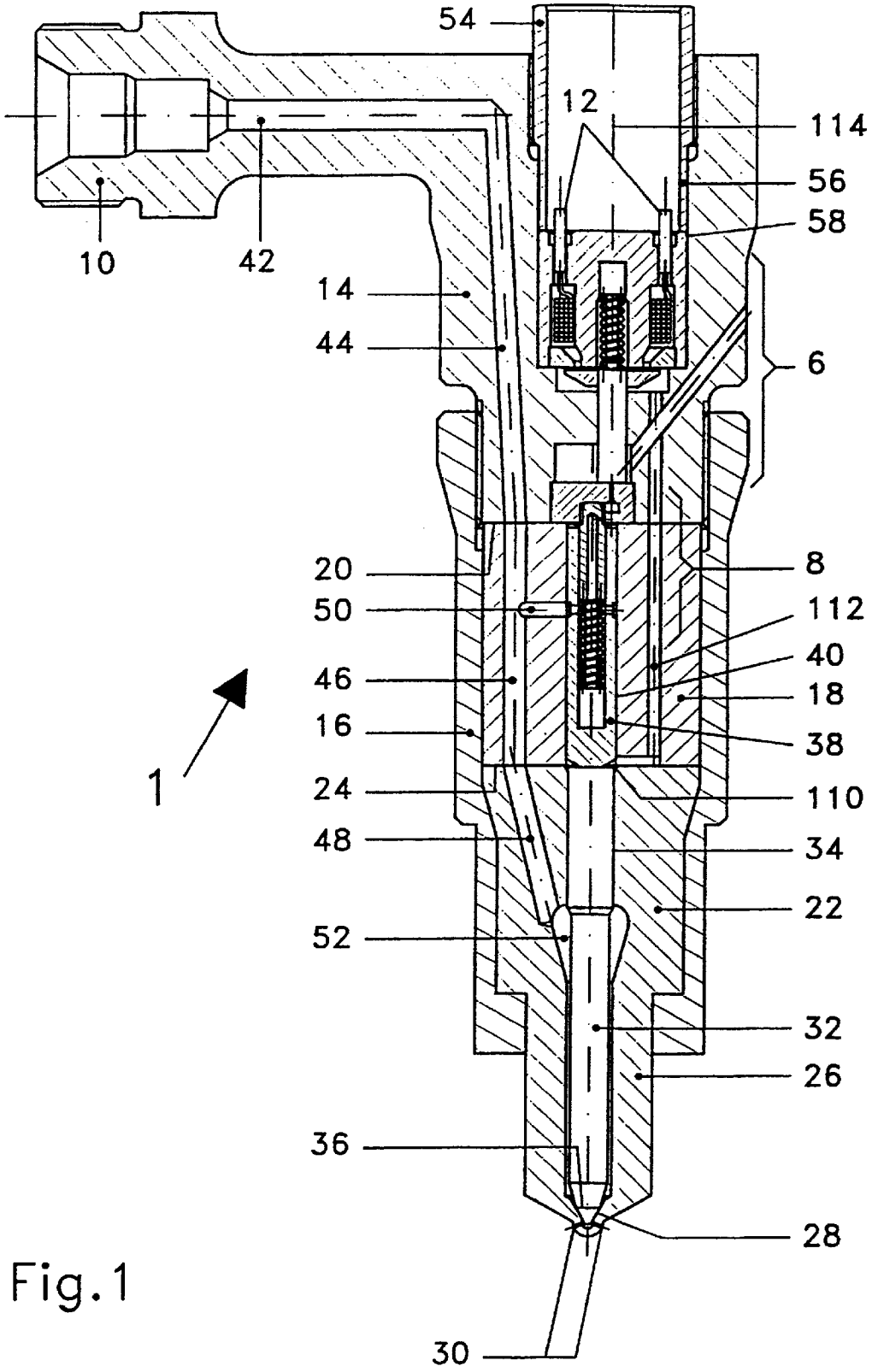
FIG. 1 shows a longitudinal section through a first embodiment of a fuel injection valve 1.
Figure 2:
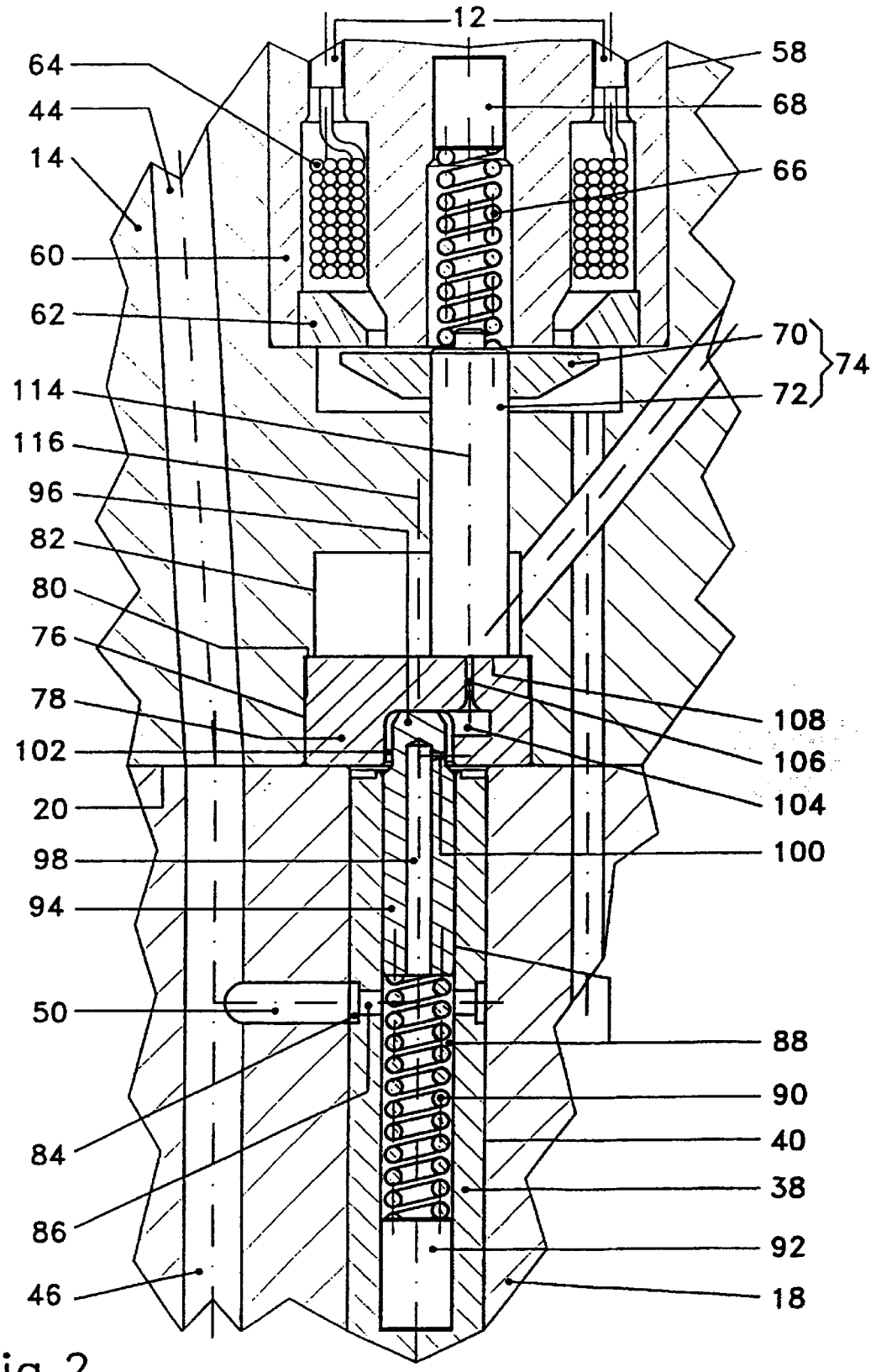
FIG. 2 shows an enlarged, partial longitudinal section through the fuel injection valve according to FIG. 1 with the arrangement for precise control of the closing sequence of the injection valve member.
Figure 3A:
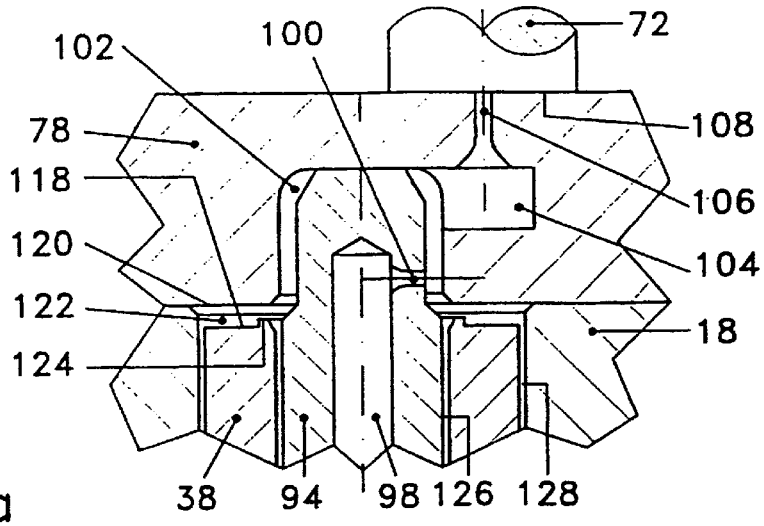
Figure 3B:
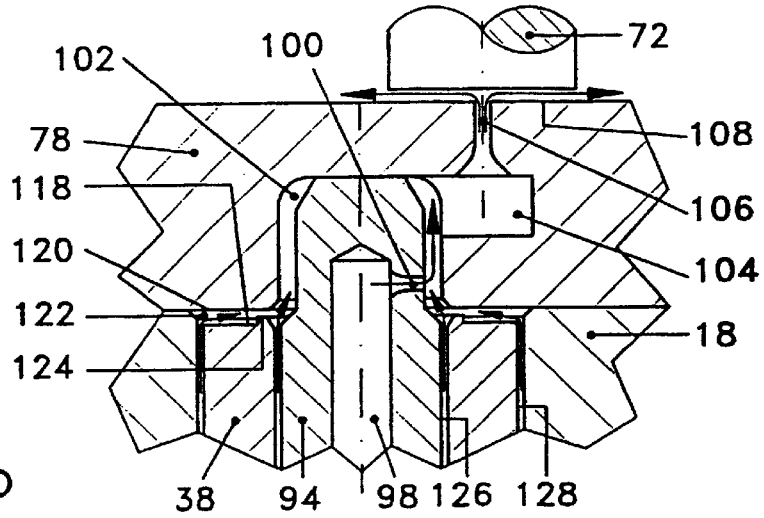
Figure 3C:
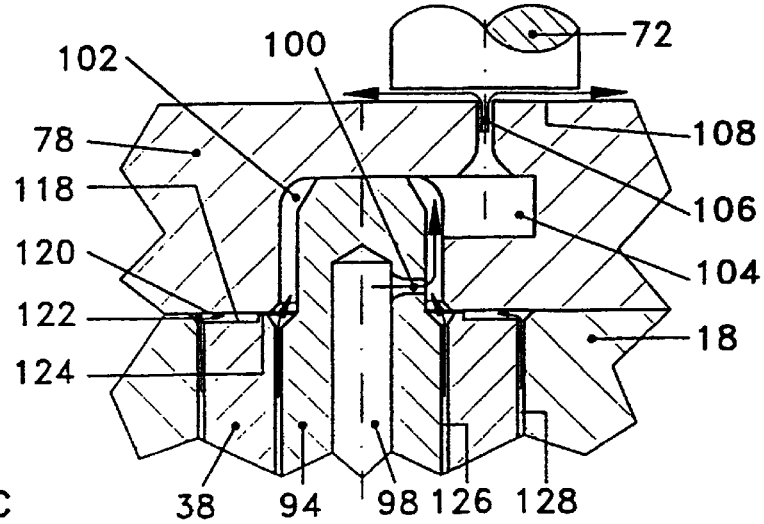
Figure 4:
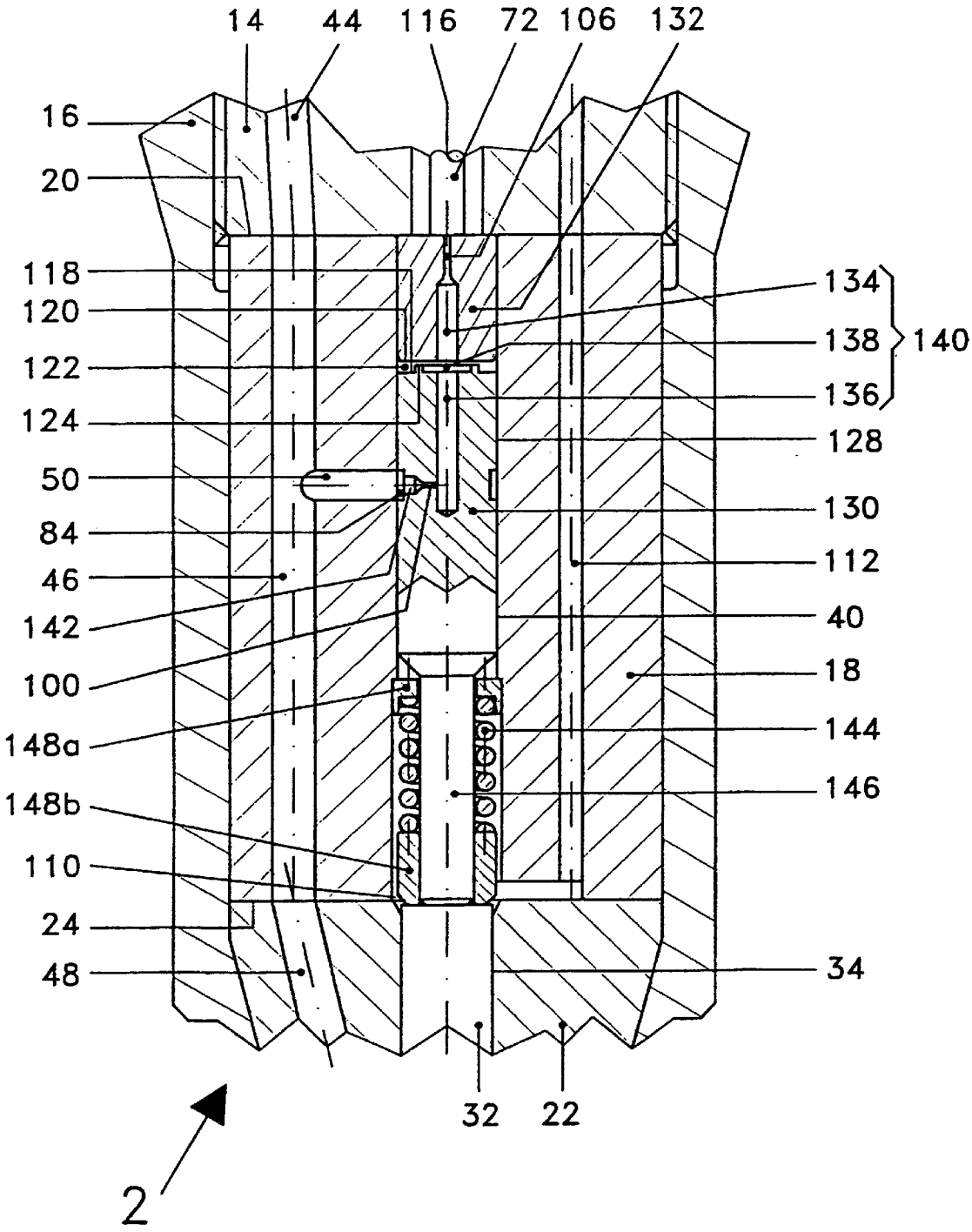
Figure 5:
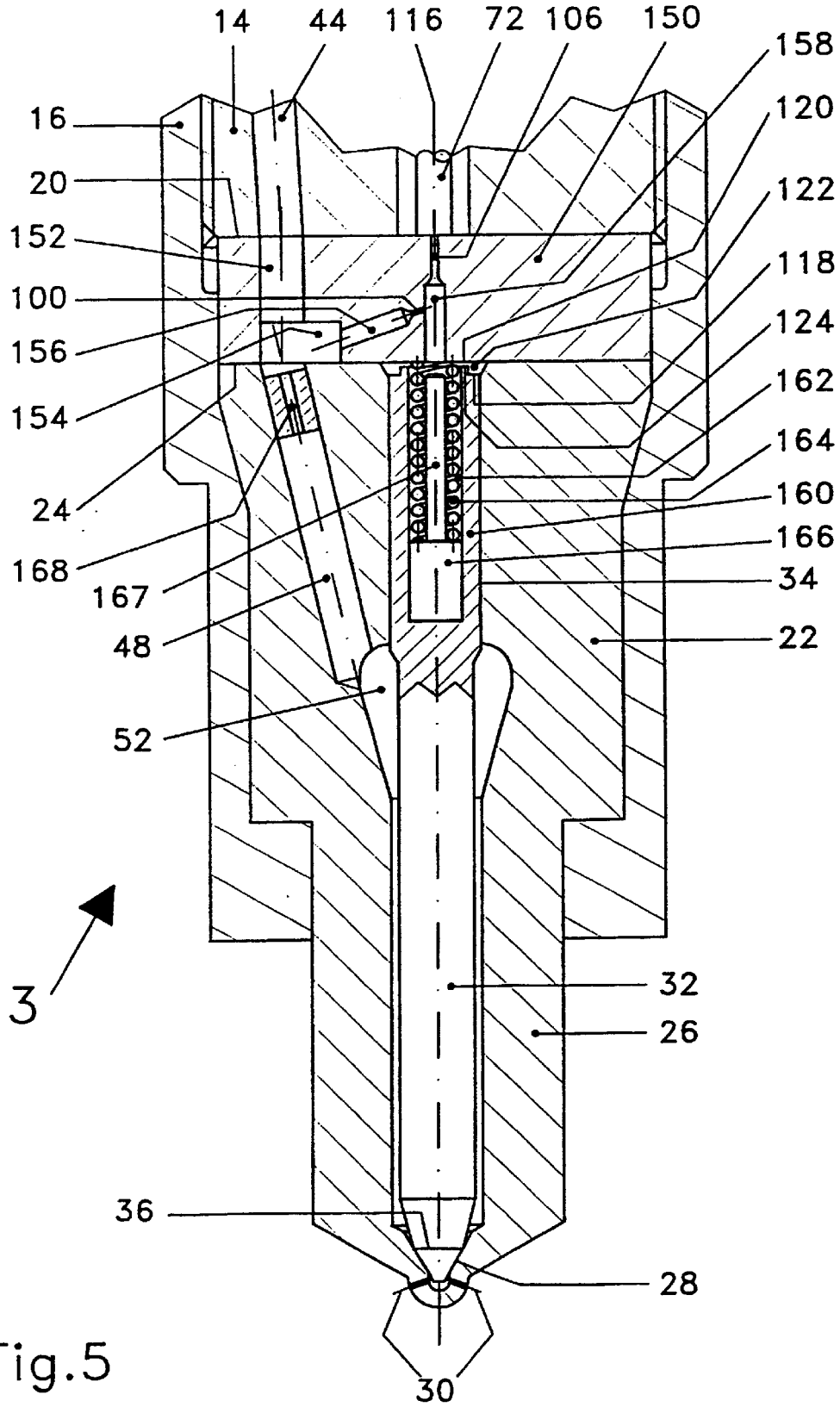
Figure 6:
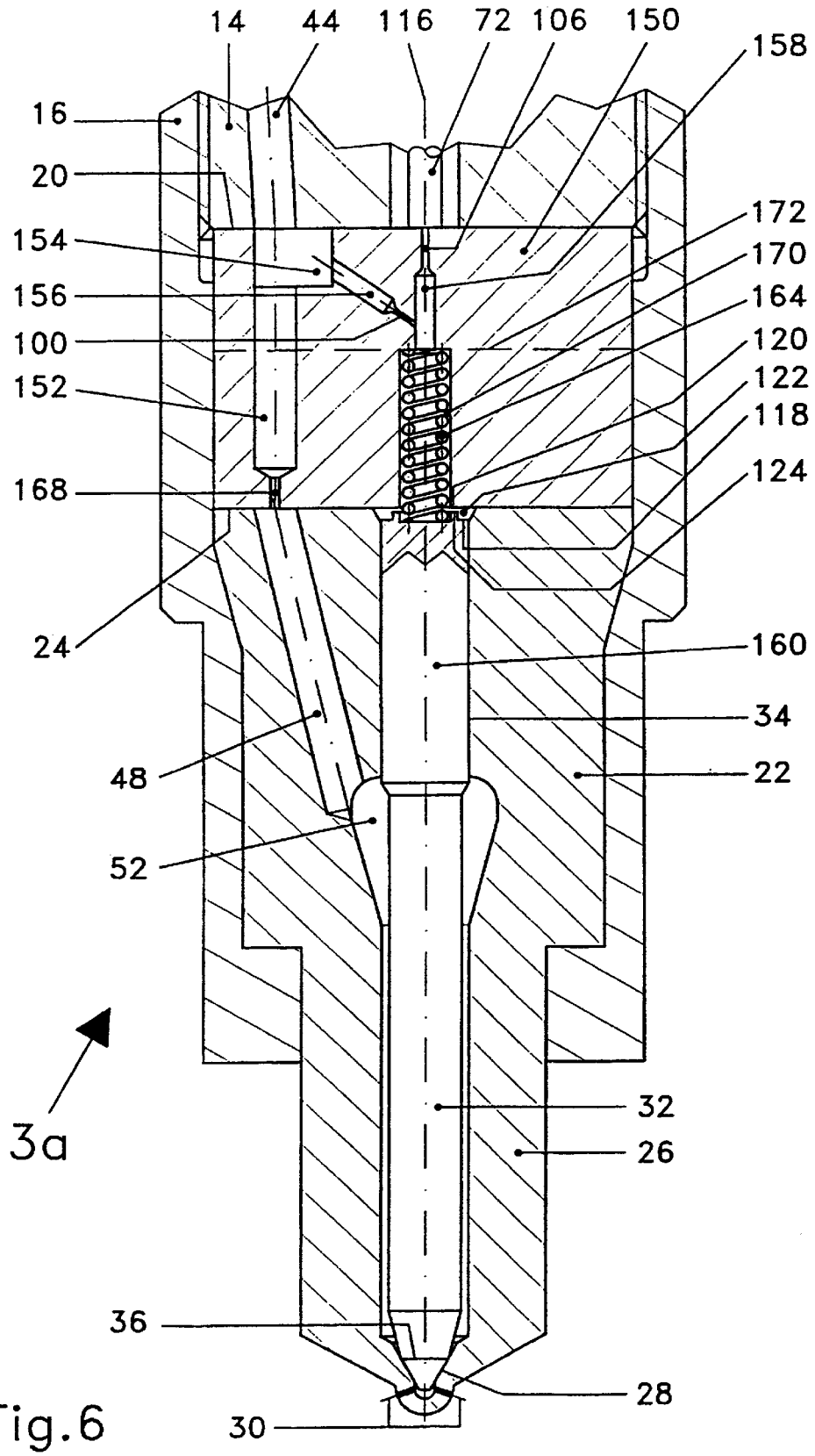

FIGS. 3*a*, 3*b* and 3*c* show three phases of the sequence for the opening movement of the injection valve member of the fuel injection valve according to FIG. 1 and 2 on a larger scale;

FIG. 4 shows a partial longitudinal section through a second embodiment of a fuel injection valve 2;

FIG. 5 shows a partial longitudinal section through a third embodiment of a fuel injection valve 3;

FIG. 6 shows a partial longitudinal section through an alternative embodiment 3*a* of the fuel injection valve 3 in FIG. 5;

According to FIG. 1 a fuel injection valve 1 is connected by way of a high-pressure fuel connection 10 to a high-pressure delivery device for the fuel and by way of electrical connections 12 to an electronic control. The high-pressure delivery device and the electronic control are not represented in the drawing.

The housing of the fuel injection valve 1 is denoted by 14. At the lower end the housing 14 is bolted to a retaining part 16 in the form of a union nut. The union nut 16 presses a middle part 18 tightly against a sealing face 20, which is situated between the housing 14 and the middle part 18. At the same time the union nut 16 presses a nozzle body 22 tightly against a sealing face 24 between the middle part 18 and the nozzle body 22. The nozzle tip 26 protrudes from the union nut 16.

The nozzle tip 26 is provided with a nozzle needle seat 28 and with multiple injection apertures 30. In the nozzle body 22 an axially adjustable nozzle needle 32 forming an injection valve member is guided so that it slides tightly inside a needle guide bore 34. The injection apertures 30 of the nozzle tip 26 can be closed by a lower end 36 of the nozzle needle 32.

At the end face the nozzle needle 32 is operatively connected to a control piston 38, axially adjustable in the middle part 18 and guided so that it slides tightly in a piston guide bore 40. The movement of the control piston 38 and hence also of the nozzle needle 32 is controlled by means of a control device 8 interacting with the solenoid valve 6, which device is described in more detail below with reference to FIG. 2.

The fuel is delivered by the high-pressure delivery device by way of the high-pressure fuel connection 10 into a fuel feed bore 42 and thence into a downwardly directed bore 44 of the housing 14. The bore 44 opens into a bore 46 made in the middle part 18. At the bottom end the bore 46 opens into a nozzle body bore 48. In the middle part 18 a further short bore 50 connects the control device 8 to the bore 46. The nozzle body bore 48 opens into an annular chamber 52 in the nozzle body 22. From the annular chamber 52 the fuel passes by way of passages (not shown further) to the nozzle needle seat 28 and to the injection apertures 30.

A locking screw 54 is screwed to the upper end of the housing 14, which screw with the extended piece 56 that extends into a seating bore 58 fixes the solenoid valve 6 in the housing 14. The solenoid valve 6 is guided radially in the seating bore 58.

According to FIG. 2 the solenoid valve 6 has a magnet body 60, in which a pole disk 62 is firmly fitted. In the magnet body 60 is a coil 64, which is connected by way of the electrical connections 12 to the electronic control (not shown). The magnet body 60 furthermore contains a solenoid valve spring 66 and a spring tensioning element 68. By selecting the length of the spring tensioning element 68 the pre-tensioning of the solenoid valve spring 66 is set to the optimum. The magnet armature 70 is fixed to the control valve stem 72, so that these two elements form a control valve 74.

A control body 78 is inserted in a bore 76 of the housing 14 and supported on the bottom surface 80 of the flange 82. The control body 78 is preferably fitted in the bore 76 with a press or sliding fit, so that no significant leakage can occur. Other fuel-tight connections might also be made, however, for example using suitable sealing rings.

The control piston 38, guided in the middle part 18 so that is slides tightly in the piston guide bore 40, has a groove 84 and a transverse bore 86 connected to the groove 84. The groove 84 is connected to the short bore 50, and the transverse bore 86 to a bore 88 made axially in the control piston 38. The bore 88 contains a needle spring 90, a spring tensioning element 92 and a control sleeve 94 guided so that it slides tightly in the control piston 38. As in the case of the solenoid valve spring 66, the spring tensioning element 92 serves for setting a certain force of the needle spring 90. The needle spring 90 on the one hand holds the nozzle needle 32 in a known manner against the nozzle needle seat 28 when no injection is taking place, and in the case of a pressureless injection system. On the other hand, together with the fuel pressure, it continuously presses the upper end 96 of the control sleeve 94 against the control body 78.

The control sleeve 94 has a longitudinal bore 98 opening into the bore 88. A first control bore 100 connects the longitudinal bore 98 to the control chamber 102. The control chamber 102 is connected to the second control bore 106 by a connection 104. By means of a flat seat 108 between control body 78 and control valve 74, the control valve 74 keeps the control bore 106 closed against the high system pressure when the solenoid valve 6 is not energized. The bore 112 (FIG. 1) returns the fuel that escapes from the second control bore 106 when the control valve 74 lifts, together with the leakage fuel, which passes into the annular chamber 110 from the two guide bores 34 and 40, in a known manner at low pressure to the high-pressure delivery device.

As shown in FIGS. 1 and 2, the longitudinal axis 114 of the seating bore 58 of the solenoid valve 6 is offset in relation to the longitudinal axis 116 common to the control piston 38 and the nozzle needle 32. This is only necessary with the dimensions of the housing 14 and the solenoid valve 6 shown, in order to provide sufficient wall thickness for the high-pressure bore 44. With greater dimensions of the housing 14, or smaller dimensioning of the solenoid valve 6, the two longitudinal axes 114 and 116 can also coincide. In this case there is no connection 104 in the control body 78.

According to FIGS. 2, 3*a*, 3*b* and 3*c* an annular relief chamber 122 is situated between the face 118 of the control piston 38 and the underside 120 of the control body 78. The control piston 38 has a continuous annular land 124 around the circumference. Furthermore, the size of the two annular leak gaps 126 (between control sleeve 94 and control piston 38) and 128 (between control piston 38 and middle part 18) is exaggerated in FIGS. 3*a*, 3*b* and 3*c*, in order to clearly show the working principle of the fuel injection valve 1.

Referring to FIGS. 1, 2, 3*a*, 3*b* and 3*c*, the working principle of the fuel injection valve 1 is now as follows: when a pulse of current is supplied to the solenoid valve 6, the control valve stem 72 after a short time moves away from the flat seat 108, exposing the second control bore 106. The fuel control pressure in the connection 104, in the control chamber 102 and in the relief chamber 122 falls. This means, on the one hand, that injection can commence due to the control piston 38 and the nozzle needle 32 lifting off from the nozzle needle seat 28. In so doing the control piston 38 moves upward in relation to the middle part 18 and to the fixed control sleeve 94. On the other hand owing to the now low control pressure, fuel flows through the first control bore 100 and through the leak gaps 126 and 128 into the control chamber 102, since the fuel pressure in the longitudinal bore 98, in the bore 88 and in the groove 84 is significantly higher than the control pressure. All of the fuel flowing into the control chamber 102 flows off through the second control bore 106. This phase is shown in FIG. 3*b*.

It is advantageous if the rate of flow of fuel through the leak gaps 128 and 126 is less than that through the first control bore 100. This is obtained by achieving a tight slide fit (with 1 to 3 microns of play, for example) between the parts.

As the stroke of the nozzle needle 32 increases, the land 124 of the control piston 38 approaches the underside 120 of the control body 78. The flow of fuel from the relief chamber 122 over the land 124 into the control chamber 102 is thereby restricted and at the full stroke of the nozzle needle 32 is greatly reduced. The pressure in the relief chamber 122 increases virtually without any delay and accordingly the flow of fuel through the leak gap 128 also diminishes. This full opening phase is shown in FIG. 3*c*. In the marginal case the land 124 forms the mechanical lift stop of the nozzle needle 32 and control piston 38. A desired damping at the end of the opening movement can be obtained by selecting the outside and inside diameter and the height of the land 124. In particular the height of the land 124 may be only a few hundredths of a millimeter (for example, 2 to 10 hundredths). The very small volume of the relief chamber 122 thereby achieved produces an immediate pressure increase in the relief chamber 122, despite the low rate of admission through the leak gap 124.

The embodiment according to the invention with the land 124 at the upper end of the control piston 38 dispenses with the free end of the control piston present in previous designs, and hence with any oscillation of the free end. The instantaneous pressure increase in the relief chamber 122 at the end of the opening movement, owing to the restrictive action of the land 124 and of the leak gap flow by way of the leak gap 128, ensures an immediate pressure balance between control piston 38 and nozzle needle 32. A reliable commencement of the closing movement is thereby also possible. This occurs when the current pulse to the solenoid valve 6 is interrupted and the control valve stem 72 closes off the second control bore 106. The disadvantages of previous solutions are avoided.

FIG. 4 shows a partial longitudinal section through a second embodiment of a fuel injection valve 2. The elements not shown may be identical to those of the fuel injection valve 1 in FIG. 1. Elements that are the same as those in FIGS. 1 to 3*c* or those that fulfill exactly the same function have been identically numbered in FIG. 4.

The fuel injection valve 2 contains the control valve shaft 72 (and consequently the solenoid valve 6, not shown) on the same longitudinal axis 116 as the control piston 130 and the nozzle needle 32. The control body 132 is fitted in the middle part 18 in the same way as in the fuel injection valve 1. The control sleeve 94 of the fuel injection valve 1 is dispensed with in the fuel injection valve 2. A short bore 142 connects the groove 84 to the first control bore 100. The control bore 100 opens into a longitudinal bore 136 made in the control piston 130, which bore together with the bore 134 in the control body 132 and the disk chamber 138 forms the control chamber 140. The needle spring 144 is situated in the lower, tapered piece 146 of the control piston 130 in a region at a low fuel pressure level. Two elements 148*a* and 148*b* position and tension the needle spring 144. The tapered piece 146 presses on the end face of the nozzle needle 32.

The omission of the control sleeve 94 simplifies this area of the fuel injection valve 2. Fitting the needle spring 144 outside the control piston high-pressure area allows more freedom in designing the volume of the control chamber 140 and in the radial dimensions of the land 124. On the other hand, a longer design of the middle part 18 must be accepted. The working principle of the fuel injection valve 2 is the same as that of the fuel injection valve 1.

In an alternative embodiment of FIG. 4 (not shown), the middle part 18 has a thread in the lower area, onto which the union nut 16 is screwed. The middle part 18 is screwed on to the housing 14 with a further nut. The middle part 18 has a flange in this upper area. This embodiment is advantageous if a long fuel injection valve has to be used.

FIG. 5 shows a partial longitudinal section through a third embodiment of a fuel injection valve 3. Again, the elements not shown are identical to those of the fuel injection valve 1 according to FIG. 1. In FIG. 5 also, the same elements as in the preceding figures or those that fulfill exactly the same function have been numbered identically to those in the preceding figures.

As in FIG. 4 the control valve stem 72 is situated on the longitudinal axis 116. A disk-shaped intermediate plate 150 is situated between the bottom end of the housing 14 and the nozzle body 22. As in FIG. 1, the intermediate plate 150 and the nozzle body 22 are tightly held together by the union nut 16 by means of the two sealing faces 20 and 24. The fuel feed bore 44 opens into a bore 152 in the intermediate plate 150. In the intermediate plate 150, the first control bore 100 is connected to the bore 152 by a recess 154 and an inclined bore 156. The first control bore 100, on the other hand, opens into a bore 158 made in the intermediate plate 150 on the longitudinal axis 116. The bore 158 is connected to the second control bore 106 and to a bore 162 made in the control piston 160.

In an embodiment not shown further, a pressed-in part, similar to the control body 78 in FIG. 2 or the control body 132 in FIG. 4, can be used instead of the intermediate plate 150.

Unlike in the fuel injection valves 1 and 2, the control piston 160 here is integrally formed with the nozzle needle 32. A needle spring 164 is located in the bore 162, together with the spring tensioning element 166. The spring tensioning element 166 has a projection 167, which serves as filling piece. Without the projection 167 the total volume of the control chamber comprising the fuel volume in the bores 158 and 162 is disadvantageously large, depending on the dimensions of these elements. It is possible to reduce this volume by means of the projection 167. Apart from this, the function of these elements remains the same.

The relief chamber 122 is again situated between the land 124 provided at the upper end of the control piston 160 and the needle guide bore 34. During the injection sequence the leakage fuel now flows from the annular chamber 52 in the nozzle body 22 by way of the leak gap between control piston 160 and needle guide bore 34 into the relief chamber 122. The working principle of the fuel injection valve 3 is again analogous to that of the previous embodiments. The design of the fuel injection valve 3 is particularly simple.

A restriction bore 168 may be situated between bore 152 and bore 48, but downstream of the admission inlet to the bore 156. Said restriction bore 168 causes a pressure drop of 5–10% of the static pressure, for example, during the injection sequence and in a manner known in the art produces a faster closing movement of the nozzle needle 32.

FIG. 6 represents an alternative embodiment of the fuel injection valve 3 in FIG. 5. In the fuel injection valve 3*a* in FIG. 6 the needle spring 164 has been fitted into a bore 170 of the intermediate plate 150. The spring tensioning element 166 in FIG. 5 has been omitted, although in FIG. 6, too, it might be fitted on the underside or on the upper side of the needle spring 164. The restriction bore 168 is now an integral part of the intermediate plate 150. The working principle of the fuel injection valve 3*a* is the same as that of the fuel injection valve 3.

In further embodiments (not shown) of the fuel injection valves 3 and 3*a* a control body, similar to the control body 78 of the fuel injection valve 1 or the control body 132 of the fuel injection valve 2, may be fitted into either the housing 14 or the intermediate plate 150. The said control body may have either just the second control bore 106 or also the first control bore 100.

If a control body with two control bores 100 and 106 is built into the housing 14, the intermediate plate 150 of the fuel injection valve 3*a* may be terminated in the plane shown by a dashed dividing line 172. In this case the needle spring 164 may be fitted from the dividing line side 172. If the force of the needle spring 164 is then transmitted to the needle piston 160 by a narrow pintle fitted on the underside of the spring, the underside 120 of the intermediate plate 150 facing the land 124 may be provided with a smaller bore than the bore 170, through which smaller bore only the narrow pintle projects. As in the embodiment of the fuel injection valve 2 in FIG. 4, this provides greater freedom in the radial dimensioning of the land 124.

The solenoid valve 6 may also be designed either with the control valve stem 72 on the longitudinal axis 116 as in FIGS. 5 and 6 or axially offset as in the fuel injection valve 1.

What is claimed is:

1. A fuel injection valve (1; 2; 3; 3*a*) for intermittent fuel injection into the combustion chamber of an internal combustion engine, with a housing (14), with a valve seat element (26) provided with injection apertures (30), with a longitudinally adjustable injection valve member (32) for closing or opening the injection apertures (30), with a control device for controlling the adjusting movement of the injection valve member (32), the control device having a longitudinally displaceable control piston (38; 130; 160) at least operatively connected to the injection valve member (32), which piston is acted upon by the fuel system pressure from a high-pressure feed line (42, 44, 46, 48) on the one hand and by the fuel control pressure in a control chamber (102, 104; 140; 158, 162; 170) on the other, the control chamber (102, 104; 140; 158, 162; 170) being connected by way of at least one first control aperture (100) to the high pressure feed line (42, 44, 46, 48), and the control pressure in the control chamber (102, 104; 140; 158, 162; 170) being controllable by opening or closing of at least one second control aperture (106), for which purpose an electrically controllable actuating element (6) is assigned to the control device, which element has an axially adjustable control valve element (72), which in its closed position seals off the second control aperture (106) and the opening movement of which, on activation of the actuating element (6), opens the second control aperture (106), and the control piston (38; 130; 160) is guided at its circumference by a tight sliding fit in a piston guide bore (40; 34) characterized in that the end of the control piston (38; 130; 160) facing the control chamber (102, 104; 140; 158, 162; 170) has an annular land (124), the control piston (38; 130; 160) is connected to the high-pressure feed line (42, 44, 46, 48) by way of the tight sliding fit in the piston guide bore (40; 34), and the tight sliding fit forms a leak gap (128), a relief chamber (122) is formed between the outlet side of the leak gap (128) and the land (124), and in that with the injection valve member (32) open, the land (124) reduces the flow of fuel from the relief chamber (122) into the control chamber (102, 104; 140; 158, 162; 170) by reducing the passage cross section, as a result of which the fuel pressure in the relief chamber (122) rises compared to the fuel pressure in the control chamber (102, 104; 140; 158, 162; 170).

2. The fuel injection valve (1; 2) as claimed in claim 1, characterized in that the control piston (38; 130) is fitted in a middle part (18), which is situated between housing (14) and nozzle body (22) and is pressed tightly against the housing (14) and the nozzle body (22) by at least one retaining part (16).

3. The fuel injection valve (1; 2) as claimed in claim 2, characterized in that the middle part (18) is provided with at least one high-pressure bore (46), which carries the fuel from the high-pressure bore (44) in the housing (14) to the high-pressure bore (48) in the nozzle body (22) and to the first control bore (100).

4. The fuel injection valve (1; 2) as claimed in claim 2, characterized in that the middle part (18) has passages (112), in order to drain off leakage fuel, which collects in an annular chamber (110) below the control piston (38; 130), at low pressure from the annular chamber (110).

5. The fuel injection valve (1; 2) as claimed in claim 1, characterized in that a control body (78; 132) is tightly fitted in the housing (14) or in the middle part (18), the control body (78; 132) is provided with an underside (120), which together with the land (124) forms the stroke limit of the control piston (38; 130).

6. The fuel injection valve (1; 2) as claimed in claim 5, characterized in that the control body (78; 132) is provided with the second control bore (106).

7. The fuel injection valve (1) as claimed in claim 1, characterized in that the actuating element (6) is axially offset in relation to a longitudinal axis (116) common to the control piston (38) and the injection valve member (32).

8. The fuel injection valve (3, 3*a*) as claimed in claim 1, characterized in that the control piston (160) is integral with the nozzle needle (32) and is guided in a guide bore (34) with tight slide fit in the nozzle body (22).

9. The fuel injection valve (3) as claimed in claim 8, characterized in that the control piston (160) is provided with a bore (162) containing a spring (164), acting in the closing direction of the injection valve member, and a spring tensioning element (166) for setting the required spring loading.

10. The fuel injection valve (3, 3*a*) as claimed in claim 1, characterized in that a restriction (168) is situated between high-pressure bore (44) and the high-pressure bore (48), but downstream of the admission inlet (156) to the first control bore (100).

11. The fuel injection valve (3, 3*a*) as claimed in claim 1, characterized in that an intermediate plate (150) is located between housing (14) and nozzle body (22) and is tightly pressed against the housing (14) and the nozzle body (22) by a retaining part (16), the intermediate plate (150) has at least one fuel passage (152) from the high-pressure bore (44) to the high-pressure bore (48) and the second control bore (106).

12. The fuel injection valve (3, 3*a*) as claimed in claim 10, characterized in that the restriction (168) is situated in the intermediate plate (150).

13. The fuel injection valve (3, 3*a*) as claimed in claim 11, characterized in that the intermediate plate (150) has the first control bore (100).

14. The fuel injection valve as claimed in claim 11, characterized in that an underside (120) of the immediate plate (150) forms the stroke limit of the control piston (160).

* * * * *